United States Patent [19]

Amos

[11] 4,448,463

[45] May 15, 1984

[54] FURNITURE ASSEMBLY FOR STORAGE OF ARTICLES

[76] Inventor: Paul E. Amos, 1132 Pennsylvania Ave., McKeesport, Pa. 15131

[21] Appl. No.: 362,504

[22] Filed: Mar. 26, 1982

[51] Int. Cl.[3] ..... A47B 43/00; A47B 77/18

[52] U.S. Cl. ..... 312/111; 312/138 R; 312/257 SK; 312/293

[58] Field of Search ..... 312/111, 304, 306, 312, 312/242, 138 R, 293, 257 A, 257 SK; 211/133

[56] References Cited

U.S. PATENT DOCUMENTS

| | | | |
|---|---|---|---|
| 323,529 | 8/1885 | D'Arcy Porter | 312/111 |
| 568,706 | 9/1896 | Shipman | 312/293 |
| 629,704 | 7/1899 | Symes | 312/138 R |
| 1,481,560 | 1/1924 | Ringer | 312/257 SK |
| 2,728,621 | 12/1955 | Kempter | 312/312 |
| 3,192,306 | 6/1965 | Skonnord | 312/257 SK |
| 3,697,363 | 10/1972 | Martinez | 312/257 A |
| 3,788,242 | 1/1974 | Hassel et al. | 312/257 SK |
| 3,847,460 | 11/1974 | Weidt | 312/111 |
| 3,926,488 | 12/1975 | Amos | 312/241 |
| 4,322,118 | 3/1982 | Shugart | 312/111 |

*Primary Examiner*—Victor N. Sakran
*Attorney, Agent, or Firm*—Shlesinger, Arkwright, Garvey & Fado

[57] ABSTRACT

A furniture assembly for storage of articles, including spaced top and bottom portions connected by legs, the legs being provided with opposed longitudinal grooves forming guideways for receiving the lateral edges of side members which extend between the top and bottom portions and are removably engaged therewith. The side members selectively comprise decorative panels, game boards, and article-holding members and drawer supports which may be interchangeably positioned in the assembly. A storage tray is supported by the top of the assembly and a cover is placed over the storage tray to provide a planar upper surface for the assembly.

19 Claims, 10 Drawing Figures

FIGURE 1
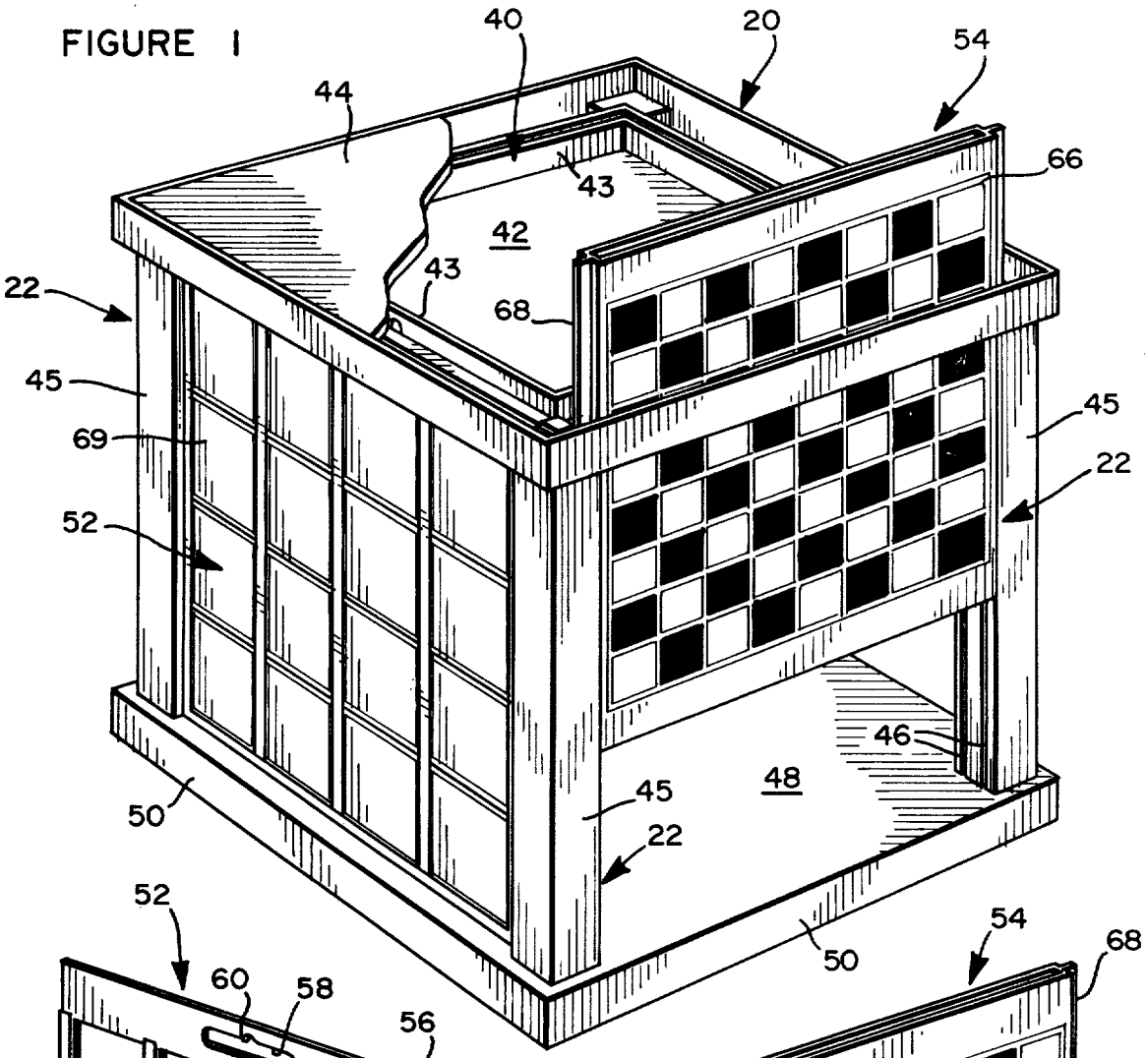
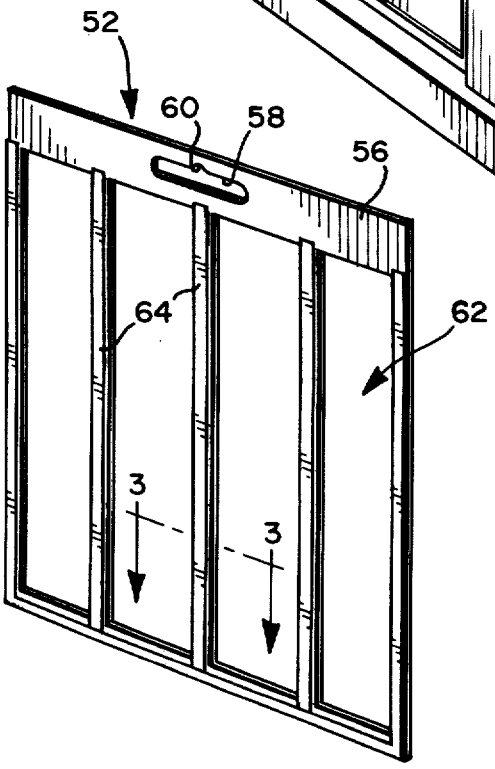
FIGURE 2
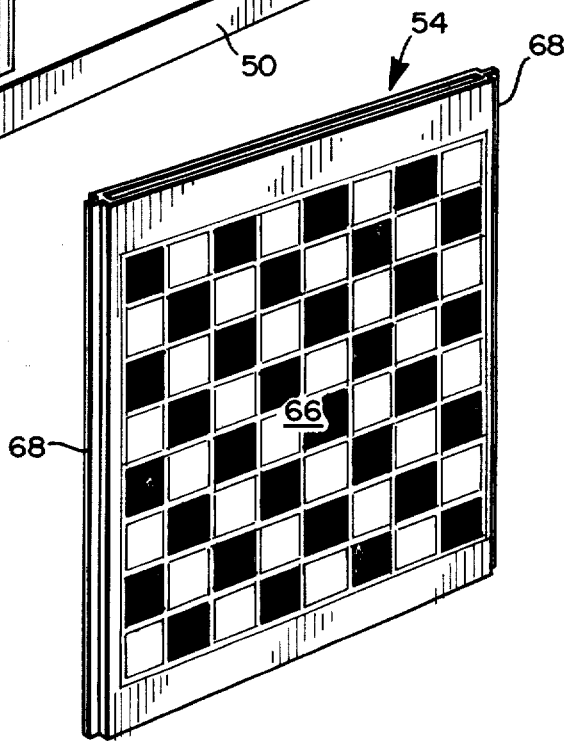
FIGURE 4

FIGURE 8
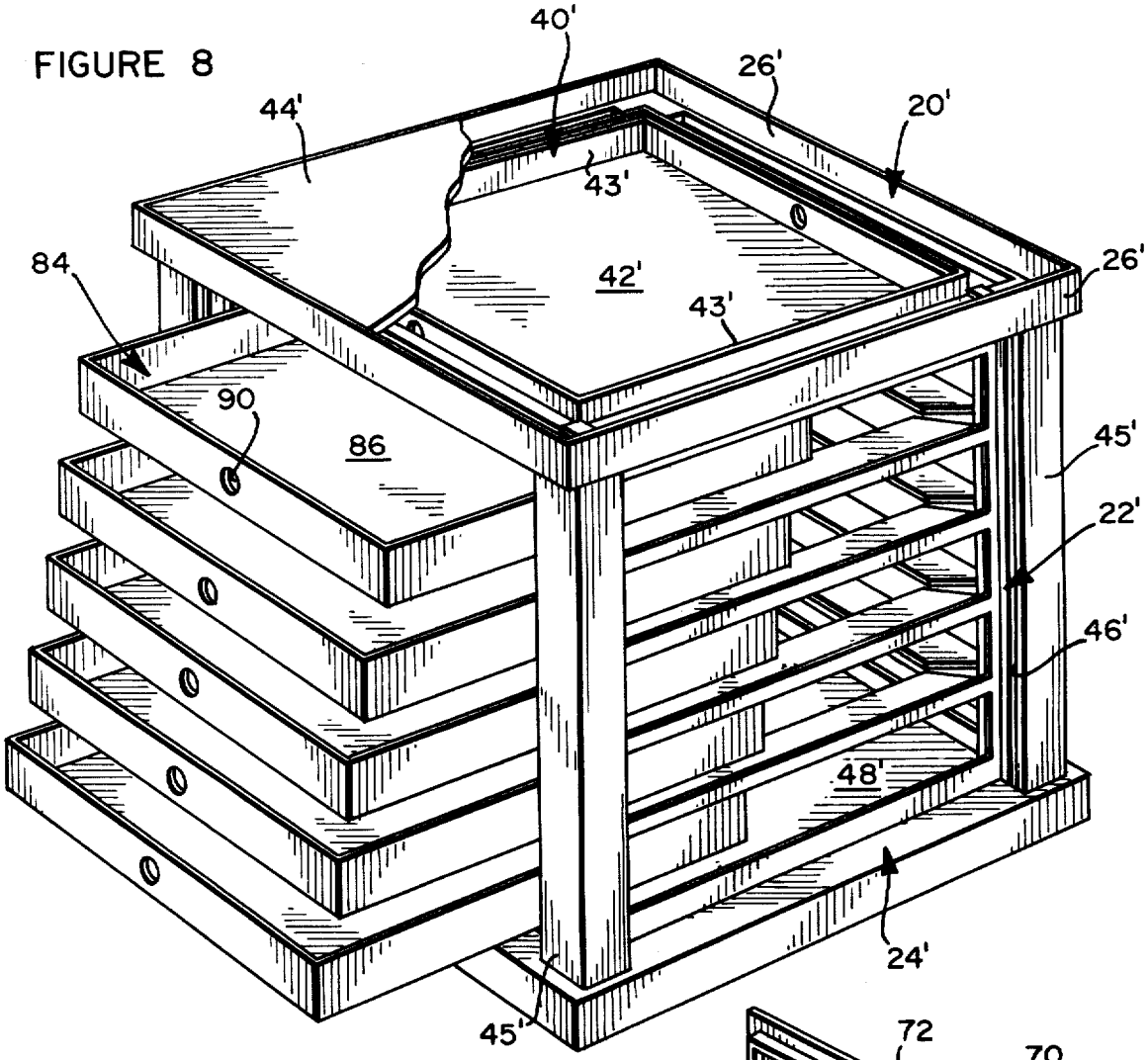
FIGURE 9
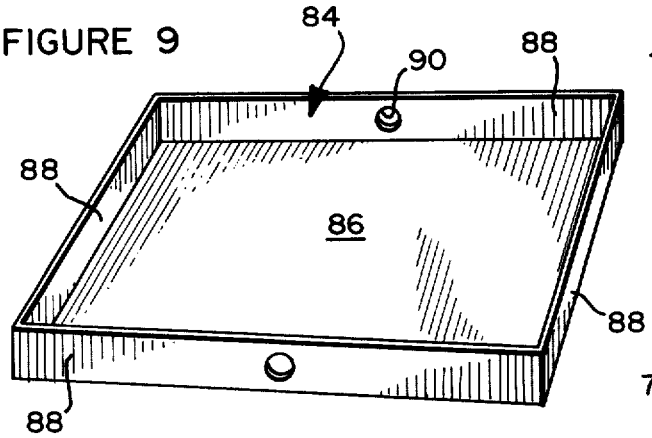
FIGURE 3
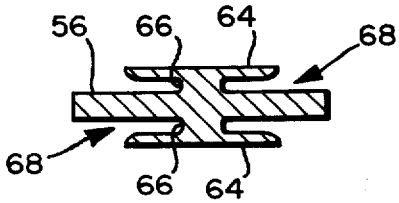
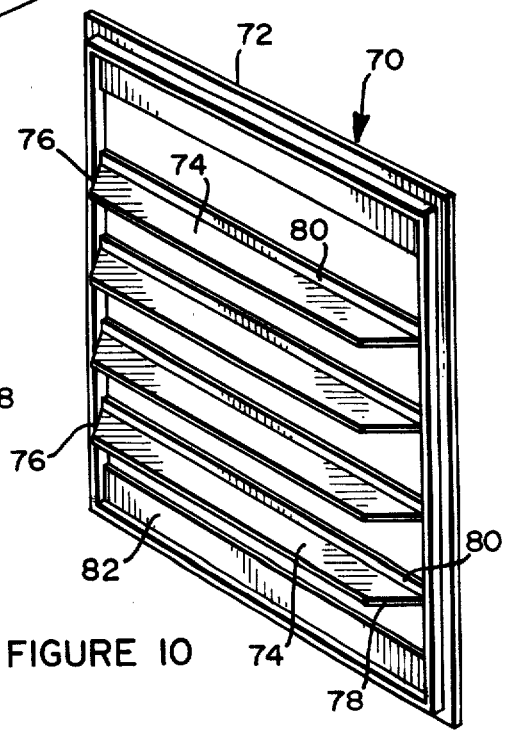
FIGURE 10

FIGURE 5
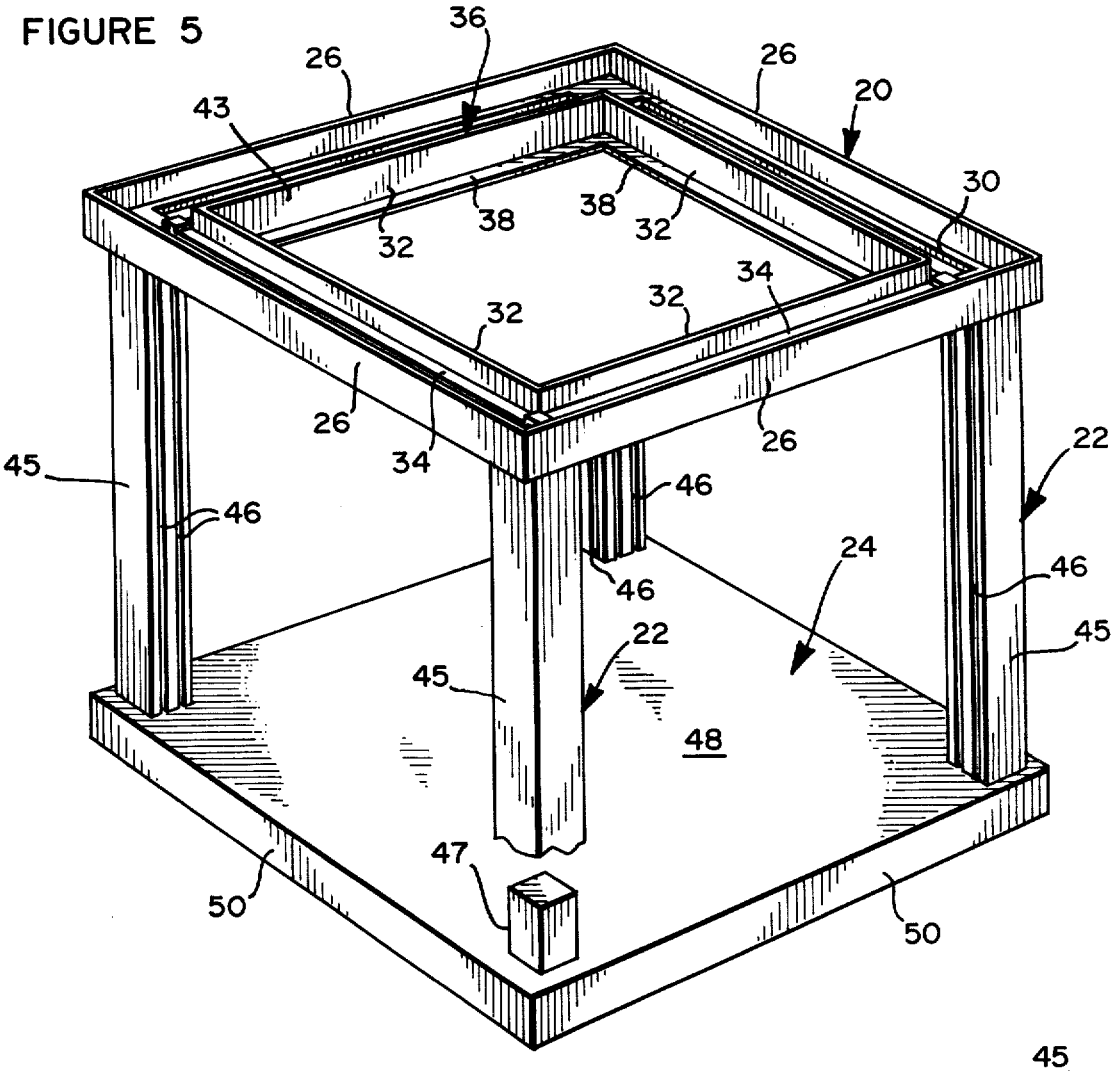
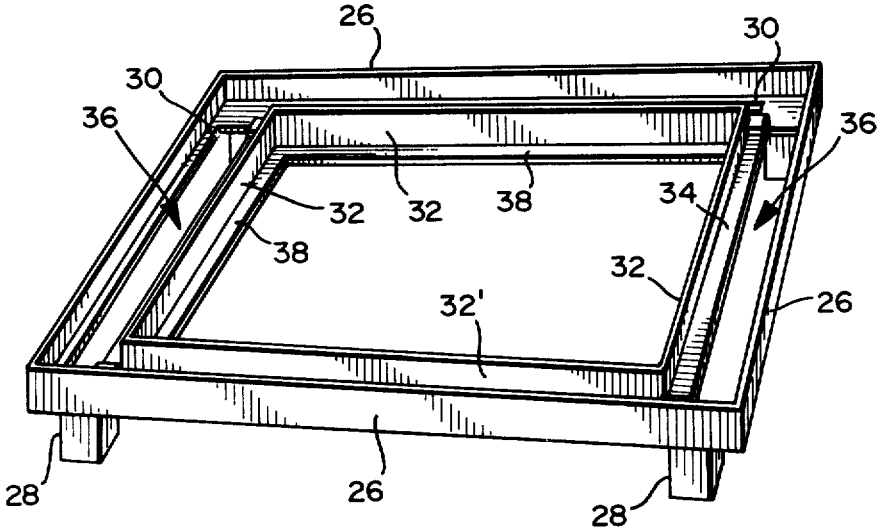
FIGURE 6
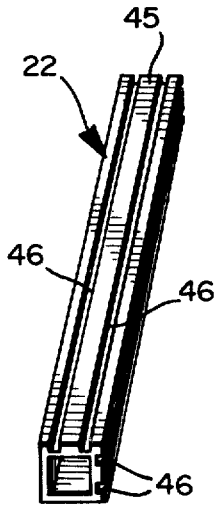
FIGURE 7

FURNITURE ASSEMBLY FOR STORAGE OF ARTICLES

BACKGROUND OF THE INVENTION

The storage of many articles, including games, photographs, player cards and various other small miscellaneous items presents a problem, particularly when limited storage space is available. I have previously designed a storage attachment for tables, wall pictures and the like, which attachment is disclosed in U.S. Pat. No. 3,926,488 granted Dec. 16, 1975. In accordance with that invention, a semiflexible collar is engaged with the planar surface of the table or wall picture to provide a storage area for game boards or other articles, and the cover member is placed over the storage area in engagement with that portion of the collar remote from the planar surface.

Although the patented attachment does afford storage space which is not otherwise available, this space is necessarily limited to a relatively small storage area which consequently restricts the articles stored to a relatively small number.

SUMMARY OF THE INVENTION

The present invention is a furniture assembly for storage of articles wherein a top portion is supported by legs, and side members extending between the legs provide a substantial storage area within the assembly, which side members are readily removable when desired for use or replacement.

These side members comprise panels which may simply be of a decorative nature, but which may also constitute items to be stored such as game boards, or are panels having article-holding means integrally formed therewith and, in themselves, provide storage space. Additionally, the side members may be in the form of spaced supports for a plurality of article-holding drawers which may be inserted into the furniture assembly.

The top of the assembly includes spaced inner and outer frames of polygonal shape, the corners of which are joined together, thereby providing spaces between the inner and outer frames through which the side members may be inserted for engagement with longitudinal grooves, forming guideways, in the legs.

The top of the assembly is further provided with a storage tray in which articles may be placed, the tray being removable for access to the interior of the assembly to permit storage of additional articles therein. A cover is placed over the storage tray to provide a planar supporting surface.

The side members of the assembly are removed from the assembly by lifting the cover from the assembly and then sliding the side members upwardly along the guideways through the space in the top of the assembly between the inner and outer frames. Replacement of the side members is effected by reversing the procedure.

The present invention provides a furniture assembly of simple, economic construction, having a storage area within the assembly itself, and wherein the side members of the assembly may also constitute storage means for articles, or supports for article-holding means.

DESCRIPTION OF FIGURES OF THE DRAWINGS

FIG. 1 is a perspective view of the furniture assembly of the present invention, portions thereof being broken away to disclose the details of construction;

FIG. 2 is a perspective view of a card-holding support member forming a part of the present invention;

FIG. 3 is an enlarged sectional view taken along the line 3—3 of FIG. 2, looking in the direction of the arrows;

FIG. 4 is a perspective view of a modified form of side panel forming a part of the present invention;

FIG. 5 is a perspective view of the furniture assembly of the present invention with the cover and side panels removed in order to disclose the details of construction of the stationary frame;

FIG. 6 is a perspective view of the top of the present assembly;

FIG. 7 is a perspective view of a leg forming a part of the present invention;

FIG. 8 is a perspective view of a modified form of the present invention;

FIG. 9 is a perspective view of a tray used in the form of invention illustrated in FIG. 8;

FIG. 10 is a perspective view of a tray support panel forming a part of the invention illustrated in FIG. 8.

DESCRIPTION OF THE INVENTION

In FIGS. 1 to 7, is illustrated the furniture assembly of the present invention which is of generally cube shape and includes a top 20 supported by a plurality of legs 22, the lower ends of which are engaged with a base 24. Top 20, legs 22 and base 24 are preferably of molded plastic construction such as polyethylene, polypropylene or other suitable material, which may be readily joined together for forming the framework of the cube-shaped assembly.

As shown to advantage in FIGS. 5 and 6, top 20 includes an outer frame which is preferably of square configuration, and includes like vertical walls 26. At each corner of the outer frame, there is provided a short downwardly extending tubular section 28 for sleeved frictional engagement with each leg 22. Proximate the lower terminal of each wall 26, there is provided an inwardly directed flange 30 which is connected to the upper extremity of short tubular sections 28.

Top 20 further includes an inner frame which is in spaced relation to the outer frame, and includes vertical walls 32 equally spaced from vertical walls 26 of the outer frame, which inner walls lie in a horizontal plane which is below the horizontal plane of the upper terminals of vertical walls 26 of the outer frame, for reasons which will be hereinafter more fully set out. The lower terminals of wall 32 are provided with outwardly directed flanges 34 which lie in spaced relation to inwardly directed flanges 30 of vertical walls 26, thereby forming a plurality of elongated slots or spaces 36. Flanges 34 also connect the inner frame with short tubular sections 28 in order to retain the inner and outer frames in fixed relation to each other.

Inwardly directed flanges 38 extend from the lower terminals of vertical walls 32 to serve as supports for a storage tray generally designated 40. Storage tray 40 includes a base 42 and vertical walls 43 which extend upwardly from the peripheral edges of base 42. It is apparent from a consideration of FIG. 5 that storage tray 40 lies within the inner frame of the assembly and is supported by inwardly directed flanges 38 of the inner frame.

A cover 44 is placed within the outer frame of top 20 and rests on the upper terminal of the inner frame thereof, to provide a planar surface for the assembly.

Legs 22 are of like construction, each of which includes an elongated tubular body 45 which is square in cross-section, the inner faces of which are provided with one or more longitudinal grooves 46 which are coextensive with the length of the legs as shown to advantage in FIGS. 5 and 7. The upper end of tubular body 45 of each leg is in sleeved engagement with short tubular section 28 of top 20, and the lower end thereof is in sleeved engagement with short tubular section 47 extending upwardly from each corner of base 24.

Base 24 includes a flat body section 48 of square configuration of approximately the same area as top 20, and depending vertical walls 50 extending downwardly from the peripheral edges of body section 48 into engagement with a supporting surface.

This structural arrangement enables the top, legs and base to be readily assembled and disassembled, thereby facilitating shipping and storage thereof.

It is a salient feature of the present invention to provide side members comprising interchangeable panels, such as indicated at 52 and 54 for use in connection with the assembly. These panels are preferably of molded plastic construction, and may be decorative, functional, or a combination of the two.

As shown to advantage in FIGS. 2 and 3, side panel 52 includes a rectangular body 56, the upper margin of which is provided with a longitudinal slot 58 providing a hand hold for facilitating insertion and removal of the side panel from the assembly, a portion of the slot being recessed at 60 in order to permit the hanging of the panel on the wall for display purposes if desired.

Body 56 is further provided with a plurality of like, spaced vertical slots 62 which extend across substantially the entire width of the panel, adjacent which are a plurality of card or picture holding strips 64, which lie in adjacent, but spaced relation, to both sides of the frame body, and are connected thereto by a web 66 which is thinner in width than strips 64, as shown in FIG. 3, thereby providing opposed guideways 68 for receiving the edge, the lateral edges of pictures or cards 69 placed between the slots. By placing the vertical strips on both sides of the frame, a large number of pictures or cards may be placed therein for display purposes either within the assembly itself or hung on a wall.

It should further be noted that when panel 52 is to be placed in the assembly, the lower portion thereof is inserted into space 36 between the inner and outer frames of top 20 so that the lateral edges of the panel engage opposed longitudinal grooves 46 of legs 22. It is further noted that insertion and removal of the panel is effected without adjustment or removal of top 20 or tray 42 contained therein. Since legs 22 may be provided with two or more longitudinal grooves 46, it is possible to store a number of panels 52 between legs 22, and still provide a substantial storage area within the assembly itself.

Panel 54 is also of flat rectangular shape, and preferably of molded construction, the body portion of which designated 66 is thicker than the body portion of panel 52. As indicated above, the faces of body section 66 may have decorative designs thereon, be provided with game boards or any other desired purpose. The lateral margins of body section 66 are provided with central flanges 68 which are coextensive with the length of the body section for engagement in opposed longitudinal grooves 46 for retaining the side panel in position as indicated in FIG. 1.

After all of the side panels are in place, a storage space of substantial size is formed between top 20 and base 24, where articles may be stored.

In FIGS. 8 to 10, there is illustrated the adaptation of the present assembly for incorporating a plurality of drawers therein for storage. The basic structure of the assembly is the same as in the form of invention illustrated in FIGS. 1 to 7, and like parts are, accordingly, identified by like, primed numbers.

In order to provide an assembly of this type, there are provided three, like support panels generally designated 70, of molded plastic construction and including a rectangular frame 72 the marginal edges of which are adapted for engagement in opposed longitudinal grooves 46' in legs 22. A plurality of spaced horizontal tray supports extend between the vertical portions of frame 72 which include a horizontal inwardly directed portion 74, the ends of which are beveled inwardly as indicated at 76 and 78. A vertical wall 80 extends upwardly from the outer periphery of horizontal section 74 and extends between the vertical portions of frame 72. At the lower end of the panel, there is provided a vertical wall 82 which extends between the marginal edges of frame 72 and serve to guide the lowermost drawer which rests on base body section 48'. Three panels 70 are inserted through spaces 36 between the inner and outer frames of top 20, the beveled portions of adjacent sections thereof fitting together to provide support for a box-like drawer 84 which is engaged therewith and is slid along the upper surface of horizontal sections 74 for the purpose of storing items within the confines of the assembly.

Each box-like drawer 84 includes a bottom or base portion 86 and upstanding vertical walls 88 which extend from the peripheral edge thereof. A finger hole 90 in vertical wall 84 facilitates opening and closing of the drawer.

In use of the assembly of the present invention, as shown in FIGS. 1 to 7, panels 52, 54 and 70 are selectively employed, the panels being readily positioned by insertion through elongated slots 36, in top 20. Articles to be stored within the assembly are then placed therein on body section 48 of base 24 between panels 52, 54, after which tray 40 is positioned within the inner frame of top 20. Cover 44 is placed over top 20 to complete assembly of the storage unit.

In use of the assembly of the present invention, as shown in FIGS. 8 to 10, panels 70 are inserted through slots 36' in top 20', following which drawers 82 are slid onto horizontal supports 94 and body section 48' of base 24'. Drawers 82 can then be opened and closed to store and remove articles. Tray 40' is positioned within the inner frame of top 20' and cover 44' is placed over top 20' to complete assembly.

The storage assembly of the present invention provides a simple storage facility of economic construction which is readily adaptable for a variety of storage functions by virtue of a plurality of interchangeable parts which may be selectively employed to meet the user's need. Although the present preferred forms of the invention have been herein shown and described, it is to be understood that such has been done for purposes of illustration only, and that various changes may be made therein within the scope of the appended claims.

What I claim is:

1. A storage assembly for the storage of articles comprising:
(a) a top member having an outer frame of polygonal shape, including a vertical wall;
(b) an inner frame of polygonal shape, including a vertical wall within, and spaced from said outer frame;
(c) means for connecting said inner and outer frames, and providing elongated spaces of uniform width between the walls thereof;
(d) supporting legs connected to and extending downwardly from the corner portions of said inner and outer frames;
(e) the opposed faces of each of said supporting legs being provided with side retaining means;
(f) side members positioned between opposed faces of said support legs and held in engagement therewith by said side retaining means, and
(g) said side members being inserted into, positioned in the assembly, and removed therefrom, through the elongated spaces between the walls of the inner and outer frames.

2. The storage assembly of claim 1, wherein:
(a) said side retaining means comprises at least one longitudinal groove in each opposing face of said supporting legs and coextensive with the length thereof, and
(b) the longitudinal grooves of opposed legs receiving the lateral margins of a side member for sliding the latter into, and out of, position in the assembly.

3. The furniture assembly of claim 2, with the addition of:
(a) a second longitudinal groove in each opposing face of said supporting legs in spaced, parallel relation to said first longitudinal groove, and
(b) a second side member, the lateral edges of which are located in said second longitudinal grooves of opposed legs.

4. The furniture assembly of claim 1, wherein:
(a) said inner frame is provided with flanges extending inwardly of the frame from the lower end of said vertical walls, and
(b) a storage tray removably positioned within said inner frame and supported by said flanges.

5. The furniture assembly of claim 1, wherein:
(a) the upper limit of said inner frame lies in a horizontal plane which lies below the horizontal plane of the upper limit of said outer frame, and
(b) a cover placed within said outer frame and supported by the upper limit of said inner frame to provide a planar top surface for the assembly.

6. The furniture assembly of claim 1, wherein:
(a) at least one of said side members includes a flat panel;
(b) a plurality of vertically arranged retaining strips secured to said flat panel in predetermined, spaced relationship, and
(c) display cards removably held between said retaining strips.

7. The furniture assembly of claim 1, with the addition of:
(a) a base of polygonal shape substantially the same size as said top member, and
(b) means on said base for receiving and holding the lower ends of said supporting legs.

8. The storage assembly of claim 1, wherein
(a) a plurality of said side members are provided with spaced horizontal supports extending inwardly of the assembly, and
(b) storage trays slid into the assembly and positioned on said side member supports.

9. A storage assembly for the storage of articles comprising
(a) a top member having an outer frame of polygonal shape
(b) an inner frame of polygonal shape within, and spaced from, said outer frame
(c) a first means for connecting said inner and outer frames, and providing elongated spaces between said outer and inner frames
(d) supporting legs connected to, and extending downwardly from, the corner portions of said outer and inner frames
(e) side members inserted into, and removed from, the assembly, through the elongated spaces between said outer and inner frames, and
(f) a second means for retaining each of said side members between said supporting legs when the side members are positioned in the assembly.

10. The storage assembly of claim 9, wherein
(a) said second means comprises opposed longitudinal grooves in opposed faces of said supporting legs for receiving the lateral edges of each of said side members.

11. The storage assembly of claim 9, wherein
(a) at least one of said side members comprises a rectangular body
(b) at least a pair of space retaining members arranged in vertical spaced relation to said body, and
(c) card members inserted between said retaining members for displaying the same.

12. The storage assembly of claim 11, wherein
(a) each of said retaining members comprises a strip, and
(b) a web connecting said strip to said body, thereby providing a guideway between said strip and body for receiving a lateral edge of the card member.

13. The storage assembly of claim 9, wherein
(a) a plurality of said side members are provided with at least one horizontal support member extending inwardly of the assembly, and
(b) a storage tray slid into the assembly and positioned on said horizontal support members.

14. A storage assembly for the storage of articles comprising
(a) a top member having an outer frame of polygonal shape, including a vertical wall
(b) an inner frame of polygonal shape including a vertical wall within, and spaced from, said outer frame
(c) a first means for connecting said inner and outer frames, and providing elongated spaces of uniform width between the walls thereof
(d) said inner frame being provided with flanges extending inwardly of the frame from the lower end of said vertical walls
(e) a storage tray removably positioned within said inner frame and supported by said flanges
(f) the upper limit of said inner frame lying in a horizontal plane which lies below the horizontal plane of the upper limit of said outer frame (g) a cover placed within said outer frame and supported by the upper limit of said inner frame to provide a planar top surface for the assembly (h) supporting legs connected to, and extending downwardly from, the corner portions of said inner and outer frames (i) side members inserted into, and removed from, the assembly through the elongated spaces between said outer and inner frames, and (j) a second means for retaining each of said side members between said supporting legs when the side members are positioned in the assembly.

15. The storage assembly of claim 14, wherein (a) said second means comprises at least one longitudinal groove in each opposing face of said supporting legs and coextension with the length thereof (b) the longitudinal grooves of opposed legs receiving the lateral margins of a side member, for sliding the latter into, and out of, position in the assembly.

16. The storage assembly of claim 15, with the addition of (a) a second longitudinal groove in each opposing face of said supporting legs in spaced, parallel relation to said first longitudinal groove, and (b) a second side member, the lateral edges of which are located in said second longitudinal groove of opposed legs.

17. The storage assembly of claim 14, wherein (a) at least one of said side members includes a flat panel (b) a plurality of vertically arranged retaining strips secured to said flat panel in predetermined spaced relation, and (c) display cards removably held between said retaining strips.

18. The storage assembly of claim 14, with the addition of (a) a base of polygonal shape substantially the same size as said top member, and (b) a third means of said base for receiving and holding the lower ends of said supporting legs.

19. The storage assembly of claim 14, wherein (a) a plurality of said side members are provided with spaced horizontal supports extending inwardly of the assembly, and (b) storage trays slid into the assembly and positioned on said side member supports.

* * * * *